US006101840A

United States Patent [19]

Watanabe et al.

[11] Patent Number: 6,101,840

[45] Date of Patent: Aug. 15, 2000

[54] AIR SEPARATION PLANTS

[75] Inventors: Akimasa Watanabe; Kazushige Arai, both of Tokyo, Japan

[73] Assignee: Nippon Sanso Corporation, Tokyo, Japan

[21] Appl. No.: 09/071,166

[22] Filed: May 4, 1998

[30] Foreign Application Priority Data

May 6, 1997 [JP] Japan ..... 9-115857

[51] Int. Cl.[7] ..... F25J 1/00

[52] U.S. Cl. ..... 62/643; 62/902; 62/905; 62/907

[58] Field of Search ..... 62/643, 902, 905, 62/907

[56] References Cited

U.S. PATENT DOCUMENTS

| | | | |
|---|---|---|---|
| 3,100,385 | 8/1963 | Becker et al. | 62/907 |
| 3,421,333 | 1/1969 | Plotz et al. | 62/907 |
| 4,038,060 | 7/1977 | Kamiya et al. | 62/907 |
| 4,496,073 | 1/1985 | Silver et al. . | |
| 5,018,639 | 5/1991 | Schäfer . | |
| 5,349,827 | 9/1994 | Bracque et al. | 62/902 |
| 5,412,954 | 5/1995 | Grenier . | |
| 5,461,871 | 10/1995 | Bracque et al. | 62/902 |
| 5,617,742 | 4/1997 | Toppel | 62/902 |

FOREIGN PATENT DOCUMENTS

| | | | |
|---|---|---|---|
| 920337 | 7/1982 | U.S.S.R. | 62/907 |

OTHER PUBLICATIONS

Japanese Patent Kokai No. 8–119187 with English Abstract.
Japanese Patent Kokai No. 3–398 with English Abstract.
Issa et al., "Structureal effects of perlite compaction on cryogenic storage vessels subjected to thermal cycles and vibrations ", *Int. J. Pres. Ves . & Piping* 64 (1995) 51–65, Elsevier Science Limited.

*Primary Examiner*—Ronald Capossela
*Attorney, Agent, or Firm*—Armstrong, Westerman, Hattori, McLeland and Naughton

[57] ABSTRACT

The air separation plant is provided with a housing for containing cryogenic equipments, at least one free-standing column to be disposed in the housing, at least one column to be disposed in the housing on a frame constituting the housing, and a powdery thermal insulator packed in the housing, having a packing density to be obtained by packing under atmospheric pressure; the free-standing column being set to have a first natural frequency of not more than 0.7 times or not less than 1.0 times as large as that of the housing. Further, the packing density of the powdery thermal insulator is 55 to 80 kg/m$^3$.

6 Claims, 18 Drawing Sheets

① without consideration of thermal insulator

② with consideration of thermal insulator

① without consideration of thermal insulator

② with consideration of thermal insulator

① without consideration of thermal insulator

② with consideration of thermal insulator

① without consideration of thermal insulator

② with consideration of thermal insulator

① without consideration of thermal insulator

② with consideration of thermal insulator

① without consideration of thermal insulator

② with consideration of thermal insulator

① without consideration of thermal insulator

② with consideration of thermal insulator

① without consideration of thermal insulator

② with consideration of thermal insulator

① without consideration of thermal insulator

② with consideration of thermal insulator

① without consideration of thermal insulator

② with consideration of thermal insulator

① without consideration of thermal insulator

② with consideration of thermal insulator

① without consideration of thermal insulator

② with consideration of thermal insulator

① without consideration of thermal insulator

② with consideration of thermal insulator

① without consideration of thermal insulator

② with consideration of thermal insulator

① without consideration of thermal insulator

② with consideration of thermal insulator

AIR SEPARATION PLANTS

BACKGROUND OF THE INVENTION AND RELATED ART STATEMENT

The present invention relates to an air separation plant, more specifically to an air separation plant which separates oxygen, nitrogen, argon, etc. as products by cooling, liquefying and distilling air and which utilizes effectively the damping effect of a powdery thermal insulator packed in it under atmospheric pressure for each equipment in the plant.

Conventionally, air separation plants are aseismatically designed based on the Aseismatic Design Standard for High-pressure Gas Equipment (Japan) etc. Such aseismatic designs are as described below.

Housings (cold boxes) and free-standing columns and/or tanks and/or the like are aseismatically designed respectively. First, each equipment is modeled by some mass points and springs for seismic analysis. Next, a horizontal design basis earthquake predetermined according to the degree of importance of a content in the plant housing, the area where the plant is installed and the ground classification is acted upon the seismic model to analyze responses of the plant to the earthquake. As a method of this response analysis, there are employed the seismic coefficient method for housings having natural periods of not higher than the values predetermined according to the ground classification and for columns and/or tanks, and the like, (including, for example, heat exchangers and/or condensers and/or reboilers, and they are all hereinafter generally referred simply to as "columns") having degrees of importance belonging to II or III (i.e. the degree of importance of the Aseismatic Design Construction regulated by the Aseismatic Design Standards for High-Pressure Gas Equipment which is based on Japanese General High-Pressure Gas Safety Regulations) and having heights of lower than 20 m measured from base plates; the modified seismic coefficient method for columns having heights of 20 m or higher and natural periods of not higher than the values predetermined according to the ground classification; and the modal response analysis method for columns and housings having natural periods of higher than the predetermined values.

Then, an estimated stress for aseismatic design, which is expressed by the sum of the earthquake loads occurring at each part (corresponding to the location of each mass point in the seismic model) of an equipment determined by the response analysis and loads caused by the internal pressure, the dead load, etc. which are applied to each part during steady operation of the plant, is calculated using a defining equation. Design specifications for each equipment are decided such that the estimated stress values at the respective parts may not exceed allowable stress values respectively. In making this decision, the mass of a thermal insulator packed in the housing is considered, but its stiffness is not considered.

Further, for those columns which are to be mounted on frames, the design modified earthquake, which is determined depending on the ratio of the natural frequency of the columns to that of the frame therefor, is used to carry out response analysis according to the seismic coefficient method. In this case, the frames are of rigid. Estimated stress values for aseismatic design are also calculated to work out aseismatic designs for them such that they may have stress values not greater than the allowable stress values. In this case again, the mass of the thermal insulator is taken into consideration but its stiffness is not, like in the case of the free-standing columns etc.

Meanwhile, the present inventors found that even a powdery thermal insulator packed under atmospheric pressure into the housing and between columns and/or tanks and the like shows coupling to influence the vibration characteristics of the housing and the columns, particularly of free-standing columns. It was found, for example, that the thermal insulator shows coupling as the housing and columns vibrate to increase in some cases responses of free-standing columns depending on the correlation between the natural frequency of the housing and that of the free-standing columns.

OBJECT AND SUMMARY OF THE INVENTION

It is an objective of the present invention to work out a design which permits discussion of safety in a state simulating an actual plant by considering the coupling behavior of a thermal insulator packed between equipments and which reduces the responses of each equipment to an earthquake resorting to the damping effect of the thermal insulator compared with a response given when such consideration is not taken, whereby to provide an air liquefaction separation apparatus.

The air separation plant according to the present invention comprises a housing for containing cryogenic equipments, at least one free-standing column to be disposed in the housing, at least one column to be disposed in the housing on a frame constituting the housing, and a powdery thermal insulator packed in the housing having a packing density to be obtained by packing under atmospheric pressure; the free-standing column being set to have a first natural frequency of not more than 0.7 times or not less than 1.0 times as large as that of the housing. Further, the packing density of the powdery thermal insulator is in the range of 55 to 80 kg/m$^3$.

According to the present invention, a highly aseismatic air liquefaction separation apparatus can be manufactured utilizing effectively the damping effect of the thermal insulator.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments taken in conjunction with the attached drawings in which:

DETAILED DESCRIPTION OF THE PREFERRED EMBODIMENTS

Figure 1:
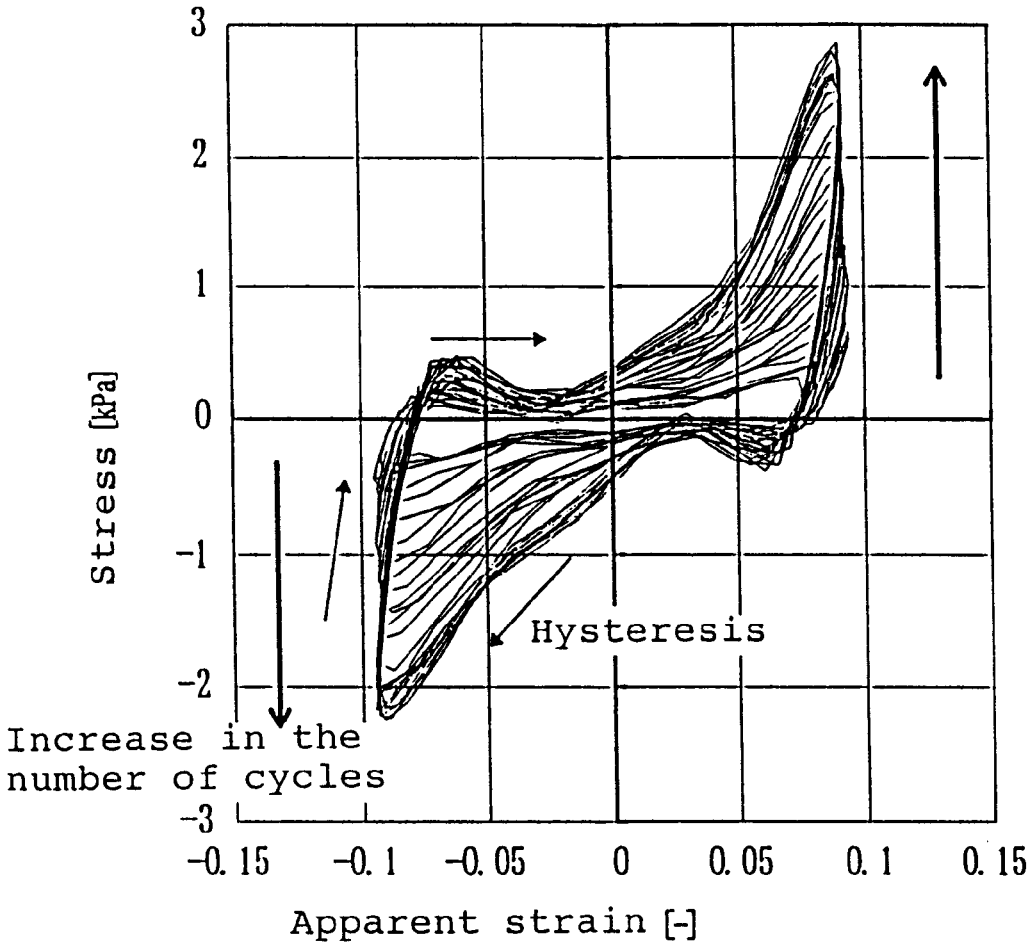
FIG. 1 is a chart showing deformation characteristics of a powdery thermal insulator packed under atmospheric pressure.

The present inventors made experiments to determine deformation characteristics of a powdery thermal insulator packed under atmospheric pressure in order to confirm its damping effect. The results are shown in FIG. 1. It was found from the results shown in FIG. 1 that deformation characteristics of the thermal insulator can be expressed by springs which are active only when they are compressed and draw a hysteresis loop and that stiffness of the thermal insulator is increased when subjected to cyclic compressive loading. Response analysis of a model of the air separation plant was carried out according to a commercial code of finite element method modeled by incorporating these deformation characteristics. Consequently, it was confirmed that responses of a free-standing column can be increased in some cases by the coupling of the thermal insulator depending on the correlation between the natural frequency of the housing and that of the free-standing column. Accordingly, an aseismatically safer air separation plant can be obtained by contriving a structure which avoids increase in the responses of free-standing columns which can be caused by the coupling of the thermal insulator and further a structure in which damping effect of the thermal insulator is effectively exhibited against the housing and the columns as well.

More specifically, if two equipments are influenced by the coupling of the thermal insulator, the thermal insulator exerts its damping effect to increase displacement of the equipment having a small displacement value relative to the other and to decrease displacement of the equipment having a large displacement value relative to the other. However, if these two equipments are displaced in the opposite directions, displacement values of them are supposed to be decreased. It should be noted here that when the strain energy accumulated in the compressed thermal insulator is released after these two equipments are displaced in the opposite directions to reach peaks substantially simultaneously, the energy is exerted in larger amount against relatively flexible equipment to notably increase its displacement until stiffness of the thermal insulator is acted again upon them. Accordingly, in two equipments having approximate natural frequency values to each other, once they start to tremble with such a timing as described above, the strain energy is continuously released against the more flexible equipment, so that it can be considered that the displacement value is in some cases increased compared with the case where these equipments are not influenced by the coupling of the thermal insulator.

Figure 2:
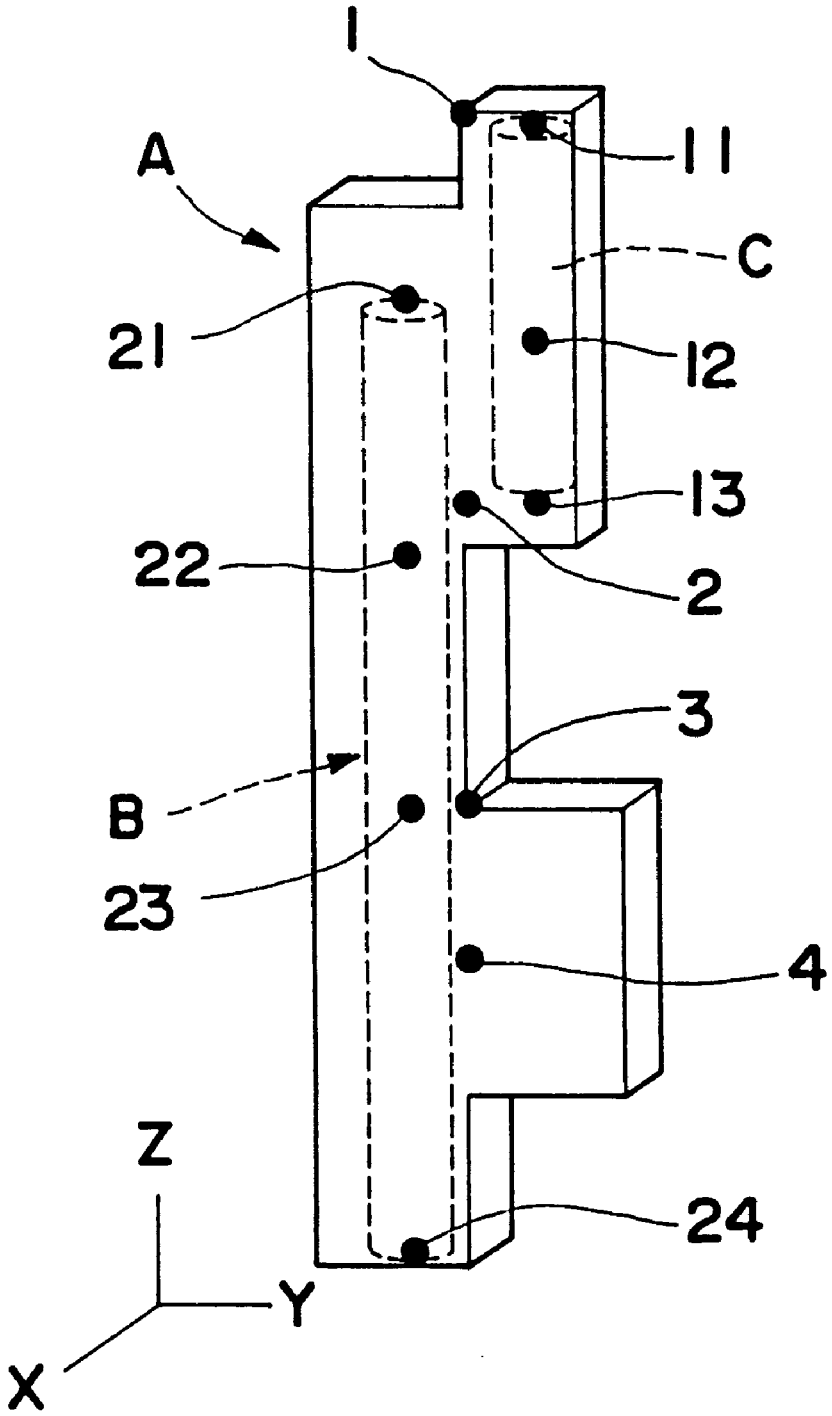
FIG. 2 is a schematic view showing a model of the air liquefaction separation apparatus employed in each of the following Examples.

FIG. 2 is a model of the air separation plant to be employed in Examples to be described later. The model consists of a housing A containing a free-standing main distillation column B and a sub-distillation column C which is mounted on a frame constituting the housing A. Packing density of the powdery thermal insulator in this model is 60 $kg/cm^3$. This value is of an ordinary packing density when the plant is constructed, i.e. in the initial packing stage. The upper limit of increase in the packing density to be brought about by continuing operation of the air separation plant after construction of it is 80 $kg/cm^3$, and substantially the same results of discussion as described below were obtained when the packing density was within the range of 55 $kg/cm^3$ to 80 $kg/cm^3$.

In each of the following Examples, the El Centrols strong motion record was exerted in the x direction for 10 seconds by the step of 0.01 second, with the natural frequency of the housing A being fixed and that of the free-standing main distillation column B being changed, so as to carry out analysis of transient response in that period.

In FIGS. 3 to 17, calculation data obtained using the above model when the coupling of the thermal insulator is not considered and those when the coupling of the thermal insulator is considered are plotted by thin curves and thick curves respectively.

EXAMPLE 1

(for a free-standing distillation column having a first natural frequency of 0.7 times as large as or smaller than that of the housing)

Figure 3:
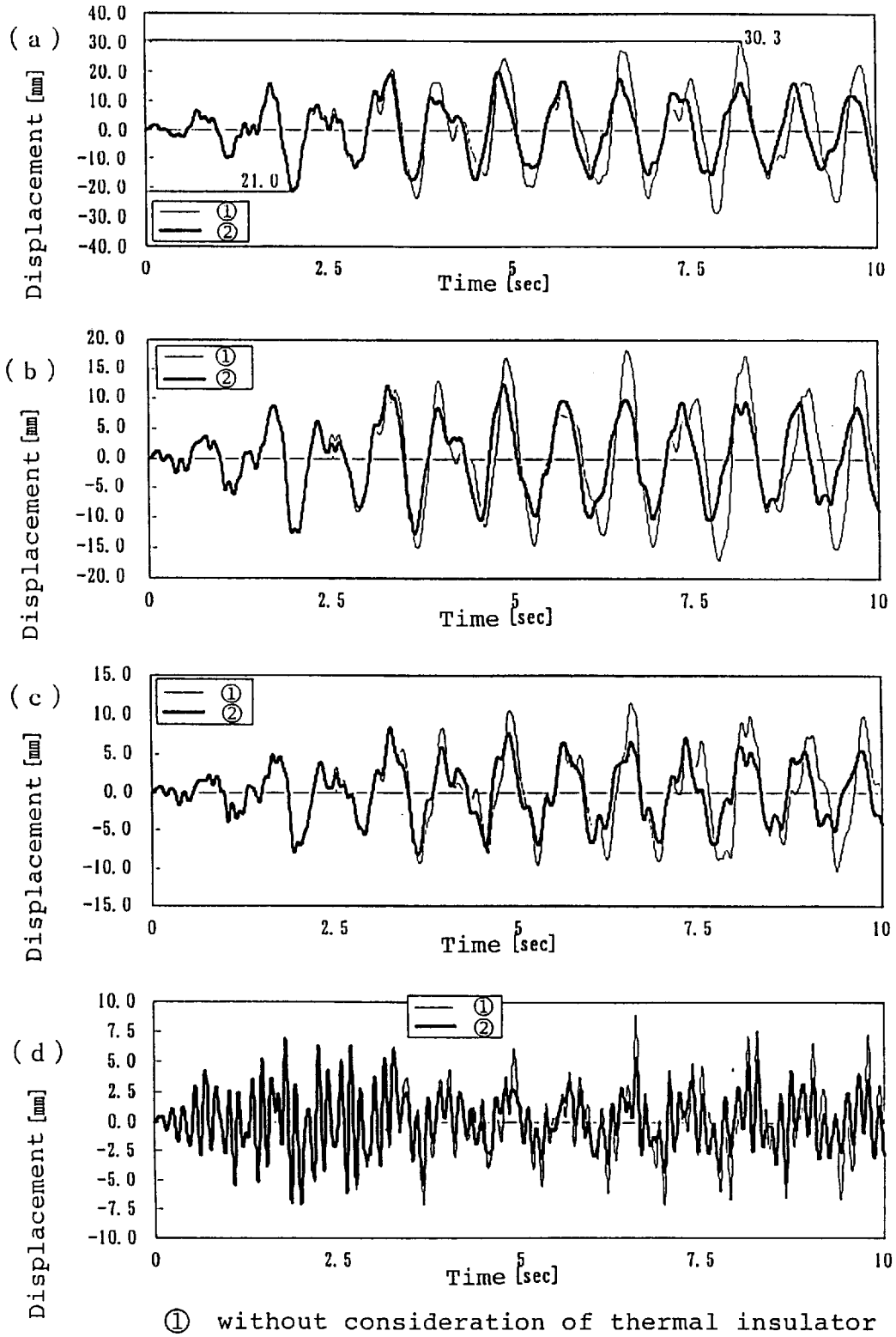
FIG. 3 shows charts illustrating transient relative displacement of a housing against the ground in Example 1.
Figure 4:
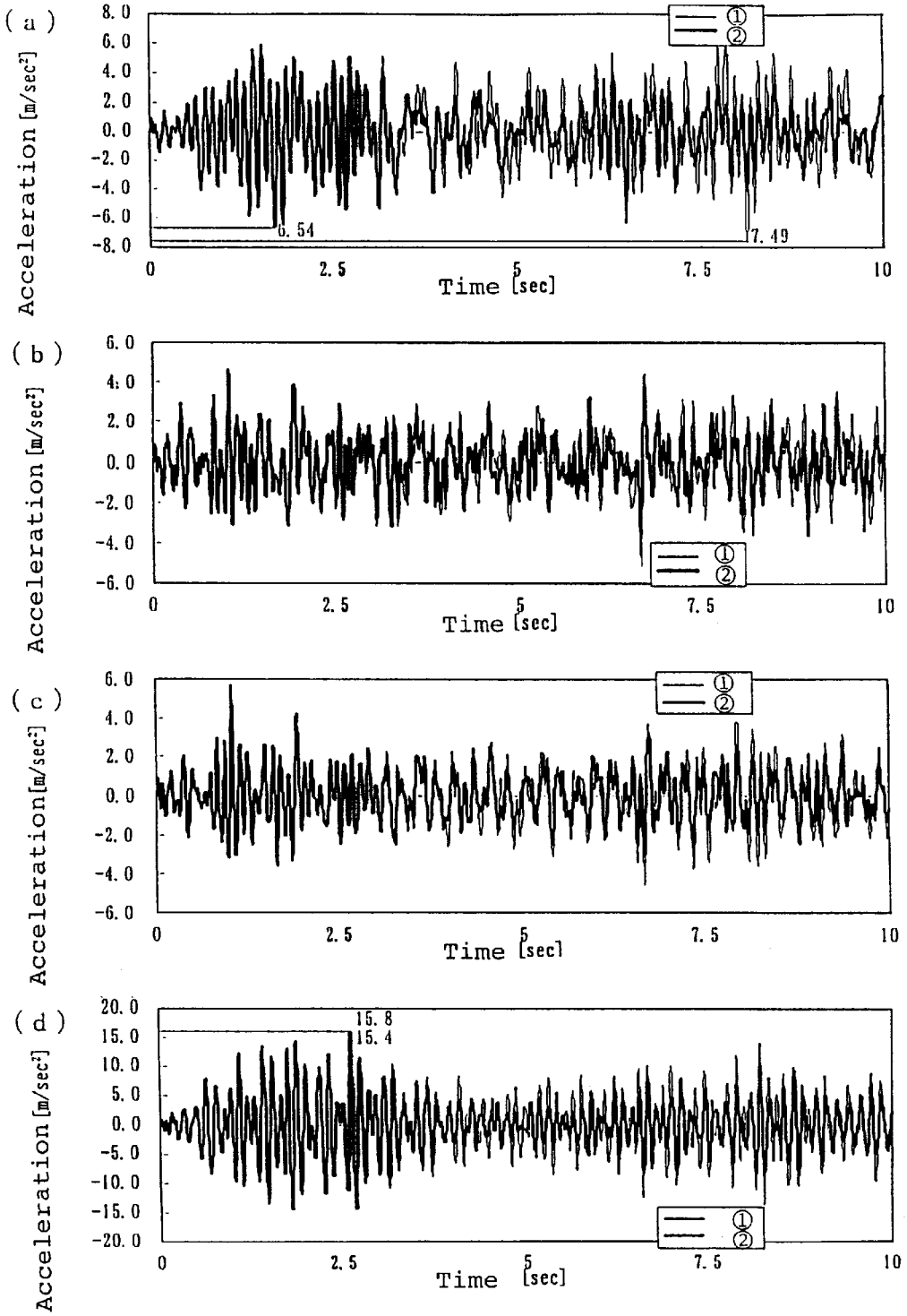
FIG. 4 shows charts illustrating transient relative acceleration of the housing against the ground in Example 1.
Figure 5:
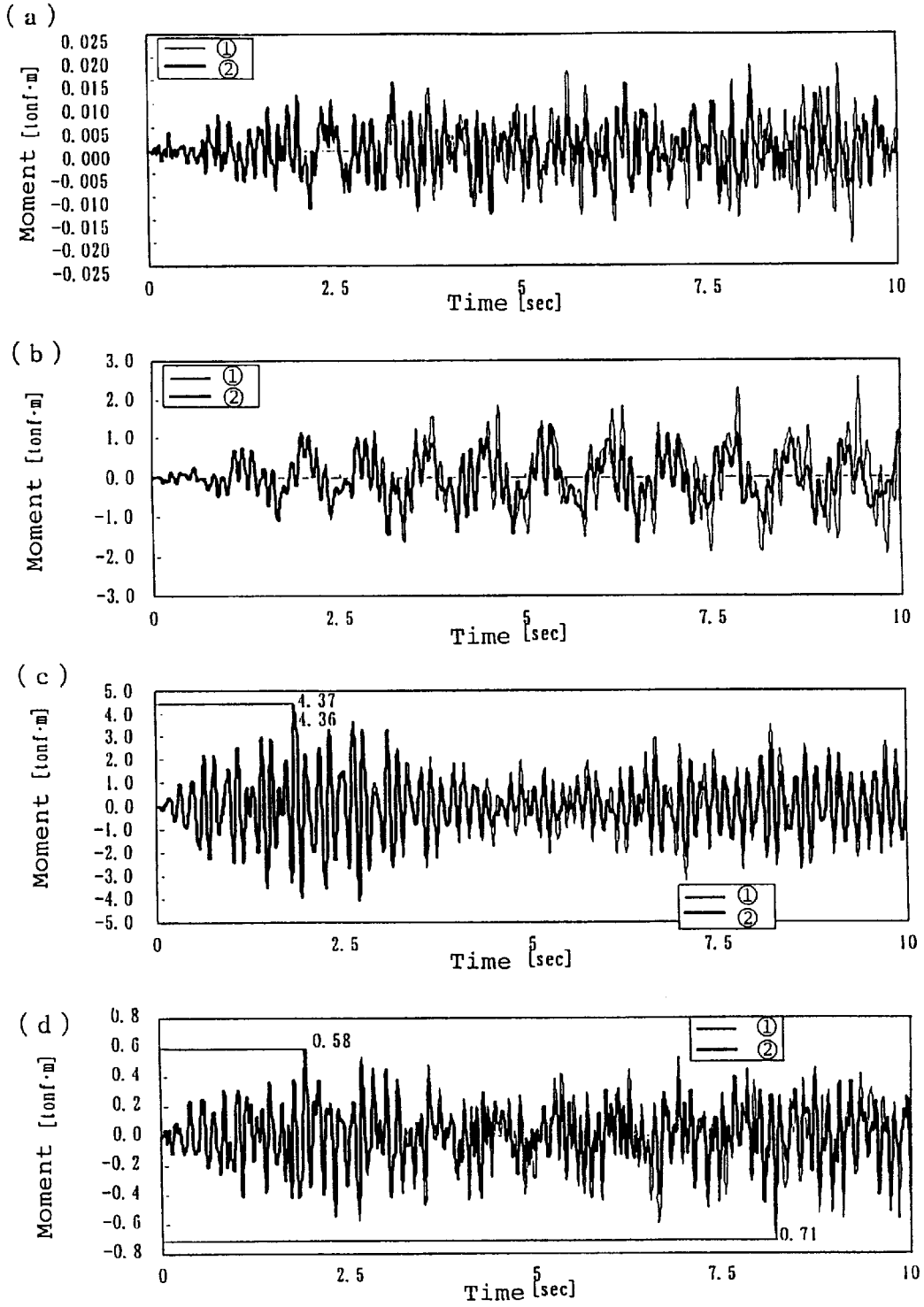
FIG. 5 shows charts illustrating transient moment of the housing in Example 1.

FIG. 3 shows transient relative displacement of the housing A against the ground; FIG. 4 shows transient relative acceleration of the housing A against the ground; and FIG. 5 shows transient moment of the housing A. In FIGS. 3, 4 and 5, transient response values at the top 1 of the housing, at the upper middle part 2 of the housing, at the lower middle part 3 of the housing and at the bottom 4 of the housing are shown in (a), (b), (c) and (d), respectively.

It can be understood from the results obtained when the coupling of the thermal insulator (trade name: Perlite, Mitsui Mining and Smelting Co., Ltd.) is not considered expressed by the thin curves in FIG. 3 that relative displacement values are increased with time, whereas it can be confirmed from the results obtained when the coupling of the thermal insulator is considered expressed by the thick curves that the relative displacement values are of substantially the same level as those expressed by the thin curves up to the time point of about 3 seconds, but the values are smaller than those expressed by the thin curves thereafter, and that the maximum displacement at each part of the housing A is also decreased. It can also be confirmed that if displacement is decreased at the top 1 of the housing A, displacement values at the other parts are likewise decreased.

Particularly, when the maximum displacement values at the top 1 of the housing where the greatest displacement occurs among other parts of the housing are compared, the value of the thick curve is decreased to 21.0 mm at the time point of 2 seconds as compared to 30.3 mm of the thin curve at the time point of 8.2 seconds.

It can be understood in FIG. 4 that the relative acceleration at each part of the housing A is of very high frequency unlike the waveform of the relative displacement in FIG. 3. This frequency value is governed by the frequency of the strong motion record input. However, the correlation between the results expressed by the thin curves in which the thermal insulator is not considered and those expressed by the thick curves in which the thermal insulator is considered is the same as in FIG. 3. The relative acceleration values of the thick curves at the time point of about 3 seconds on are decreased compared with those of the thick curves, and it can be confirmed that the acceleration values at the respective parts are decreased particularly when displacement at the top 1 of the housing shown in FIG. 3(*a*) is decreased. The maximum acceleration value at the top of the housing expressed by the thick curve is decreased to 6.54 m/sec$^2$ at the time point of 1.7 seconds as compared to 7.49 m/sec$^2$ of the thin curve at the time point of 8.2 seconds. However, when the maximum values at the bottom 4 of the housing where the greatest acceleration occurs among other parts of the housing are compared, the value of the thick curve is increased slightly to 15.8 m/sec$^2$ at the time point of 2.6 seconds as compared to 15.4 m/sec$^2$ of the thin curve at the time point of 2.6 seconds.

In FIG. 5, it can be understood that the waveforms of the moment at the lower middle part 3 of the housing and at the bottom 4 of the housing are similar to that of relative acceleration at the bottom 4 of the housing (FIG. 4(*d*)) where the greatest acceleration occurs among other parts of the housing, while the waveform of the moment at the upper middle part 2 of the housing is similar to the waveform of displacement at the upper middle part 2 of the housing (FIG. 3(*b*)). It can be surmised from these results that the moment of the entire housing is influenced greatly at the bottom by the acceleration, and the influence of acceleration is exhibited more obtusely toward the middle part, so that the influence of acceleration is exhibited acutely. Further, at the top 1 of the housing, the influence of acceleration becomes acute again. Like in FIGS. 3 and 4, it can be confirmed that the moment expressed by the thick curves at the time point of about 3 seconds on are smaller than those of the thin curves and that the maximum values are decreased, and it can also be understood that when displacement at the top of the housing in FIG. 3(*a*) is decreased, the values of moment at the other parts are also decreased.

Particularly, the maximum moment value at the bottom 4 of the housing expressed by the thick curve is decreased to 0.58 tonf·m at the time point of 1.9 seconds as compared to 0.71 tonf·m of the thin curve at the time point of 8.2 seconds, and referring to the maximum value at the lower middle part 3 of the housing where the greatest moment occurs among other parts of the housing, the value of the thick curve is decreased slightly to 4.36 tonf·m at the time point of 1.9 seconds as compared to 4.37 tonf·m of the thin curve at the time point of 1.9 seconds. The maximum moment values at the other parts are also decreased, and if the displacement at the top 1 of the housing A is decreased, displacement at each part of the housing A is also decreased likewise, whereby the value of moment at each part of the housing A is also increased.

Figure 6:
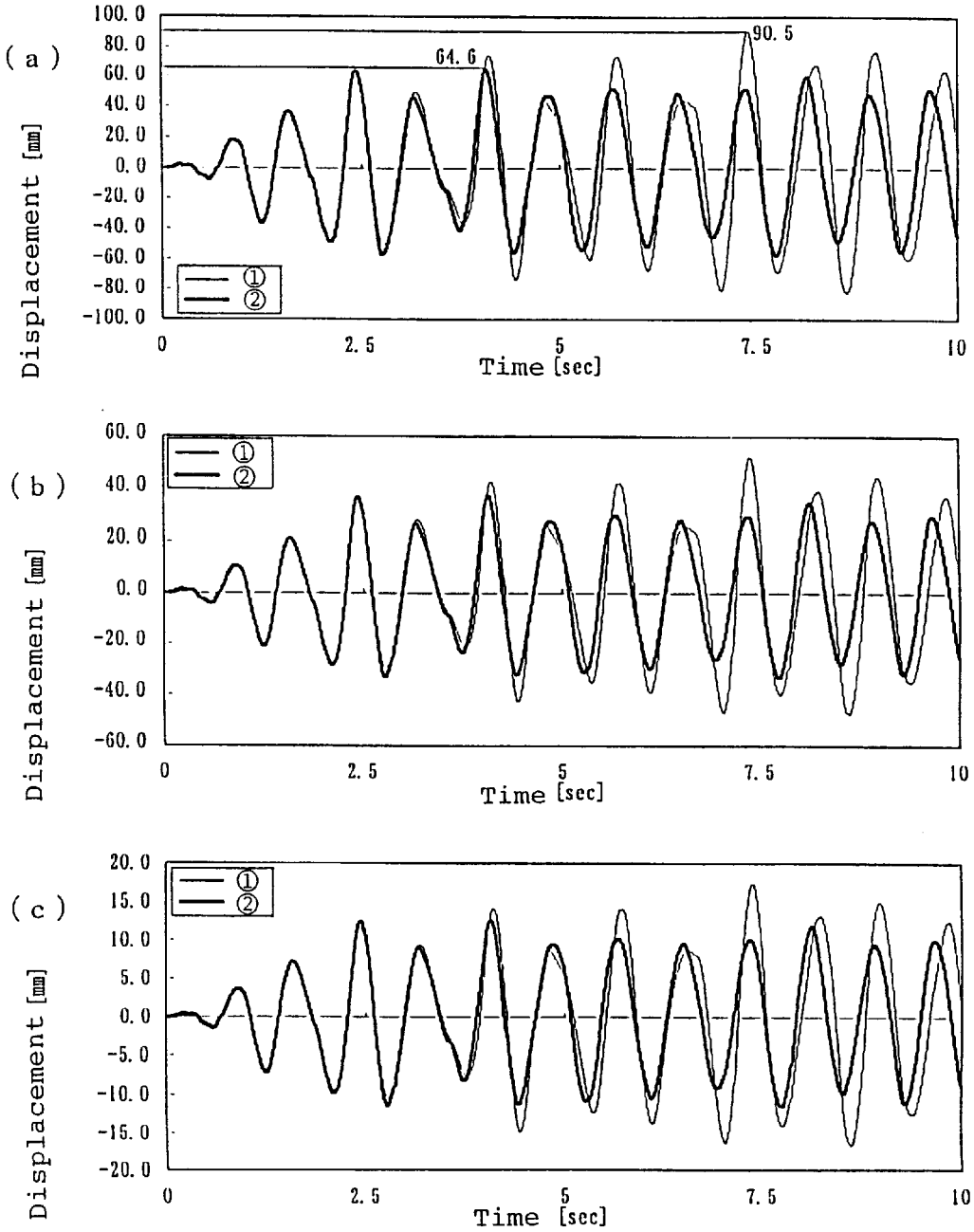
FIG. 6 shows charts illustrating transient relative displacement of a sub-distillation column against the bottom thereof in Example 1.
Figure 7:
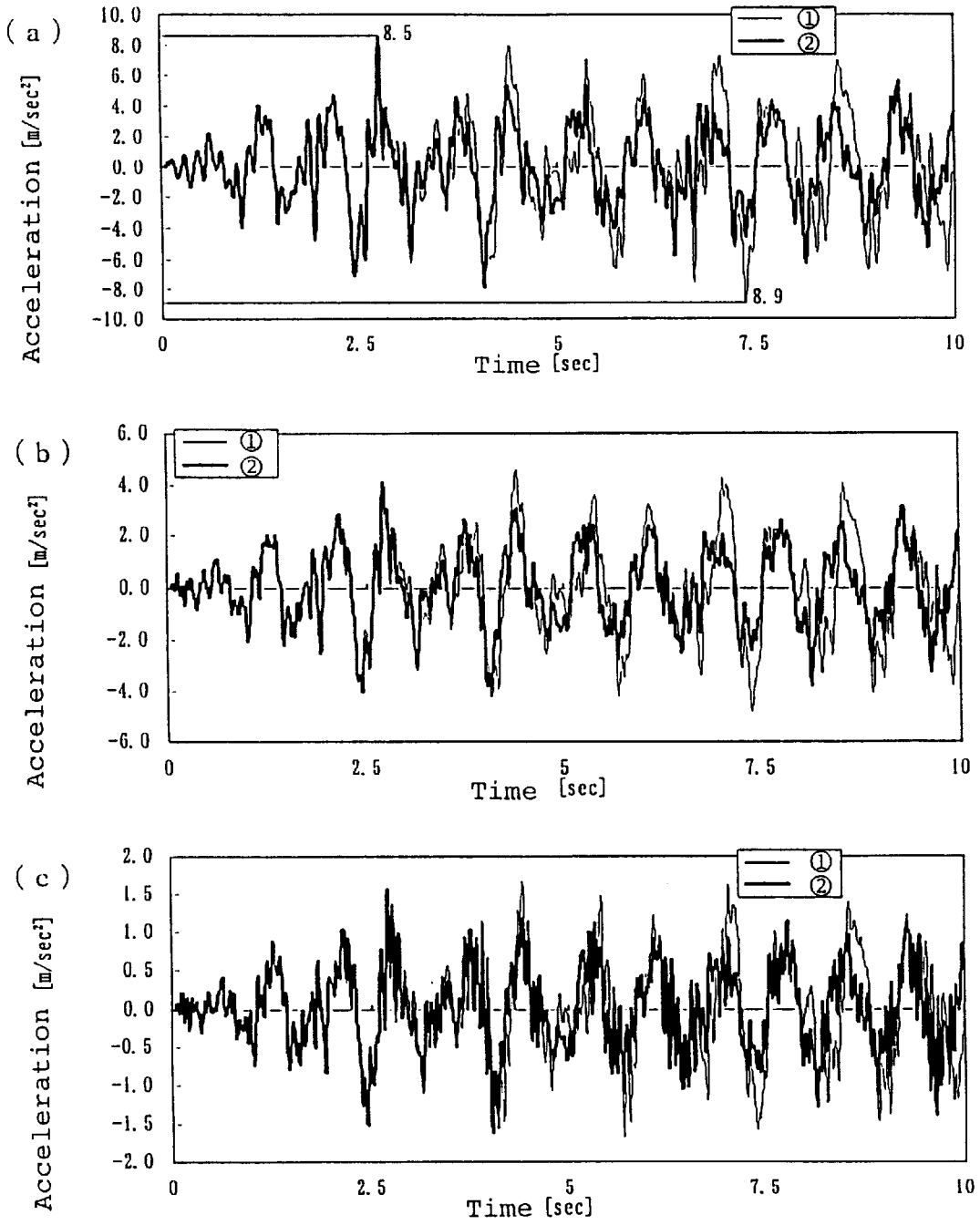
FIG. 7 shows charts illustrating transient relative acceleration of the sub-distillation column in Example 1.
Figure 8:
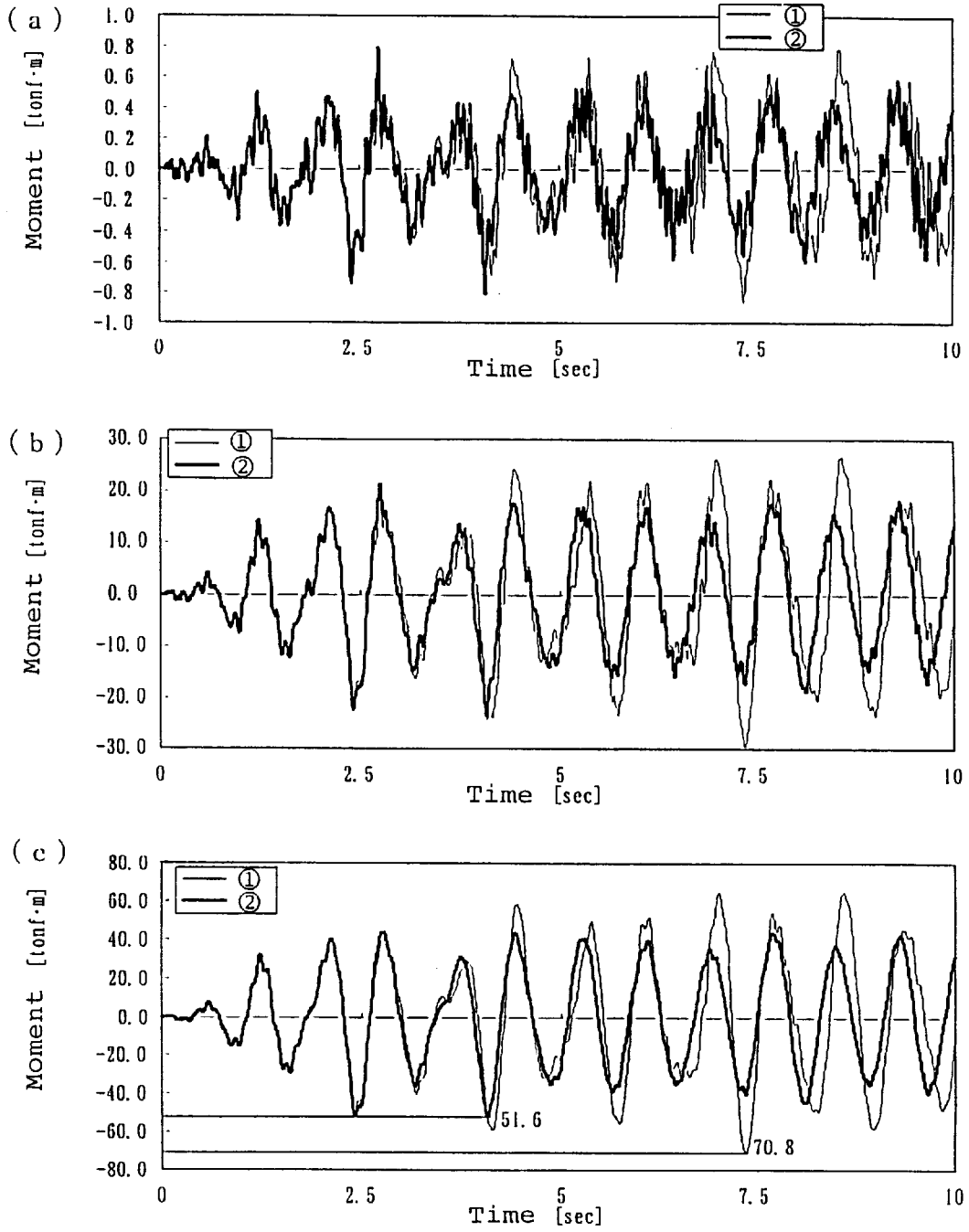
FIG. 8 shows charts illustrating transient moment of the sub-distillation column in Example 1.

FIG. 6 shows transient relative displacement of a sub-distillation column C disposed on a frame utilizing the upper middle part 2 of the housing against the bottom of the column C; FIG. 7 shows transient relative acceleration of the sub-distillation column C; and FIG. 8 shows transient moment of the sub-distillation column C. In FIGS. 6, 7 and 8, transient response values at the top 11 of the sub-distillation column, at the middle part 12 of the sub-distillation column and at the bottom 13 of the sub-distillation column illustrated in FIG. 2 are shown in (a), (b) and (c) respectively.

It can be understood in FIG. 6 that the displacement values at each part expressed by the thin curve and the thick curve occurred in the same direction with the same timing and reached the maximum displacement values simultaneously. Meanwhile, the waveform of the sub-distillation column C is substantially the same as that of the transient displacement at the upper middle part 2 of the housing (FIG. 3(*b*)). Further, it can be understood that, when the sub-distillation column C is influenced together with the housing A by the coupling of the thermal insulator, the relative displacement expressed by the thick curve at the time point of about 3 seconds on is decreased compared with that of the thin curve like the transient displacement of the housing A and that the maximum value at each part is also decreased. The reason is surmised to be that the displacement of the housing A is decreased by being influenced together with the free-standing distillation column (main distillation column B) by the coupling of the thermal insulator, and the displacement of the sub-distillation column C disposed on the frame constituting the housing A is also decreased and that the sub-distillation column C is influenced by the housing A not only via the supporting member (frame) but also via the coupling of the thermal insulator, whereby displacement of the sub-distillation column C is restricted by the housing A having smaller response value compared with those of the column C. Particularly, the maximum value at the top 11 of the sub-distillation column expressed by the thick curve is decreased to 64.6 mm at the time point of 4.1 seconds as compared to 90.5 mm of the thin curve at the time point of 7.4 seconds.

In FIG. 7, it can be understood that since the force of excitation to be input to the sub-distillation column C is causative of displacement of the housing A at the site of installation, the acceleration values at each part expressed by the thin curve and the thick curve are shifted in the same direction with the same timing like in the displacement waveform. It can also be confirmed that the relative acceleration expressed by the thick curve at the time point of about 3 seconds on is decreased compared with that of the thin curve and that its maximum acceleration value is also decreased. Particularly, the maximum value at the top 11 of the sub-distillation column expressed by the thick curve is decreased to 8.5 m/sec$^2$ at the time point of 2.8 seconds as compared to 8.9 m/sec$^2$ of the thin curve at the time point of 7.4 seconds.

In FIG. 8, referring to the moment at each part, while some influence of the acceleration at the top 11 of the sub-distillation column (FIG. 7(*a*)) is observed in the transient waveform at the upper part, it can be understood that the moment is shifted with the same timing as that of displacement, that the moment is also decreased where the displacement is decreased and that the maximum moment value and the maximum displacement value appear simultaneously. It can also be confirmed that the moment expressed by the thick curve at the time point of about 3 seconds on is decreased compared with that of the thin curve, and that its maximum moment value is also decreased. The maximum value at the bottom 13 of the sub-distillation column expressed by the thick curve is decreased to 51.6 tonf·m at the time point of 4.1 seconds as compared to 70.8 tonf·m of the thin curve at the time point of 7.4 seconds. Further, the maximum moment values at the other parts are also decreased, and if the displacement at the top 11 of the sub-distillation column is decreased, displacement values at the other parts of the sub-distillation column C are also decreased, so that the moment values at the respective parts of the sub-distillation column C disposed on the frame constituting the housing A are also decreased.

Figure 9:
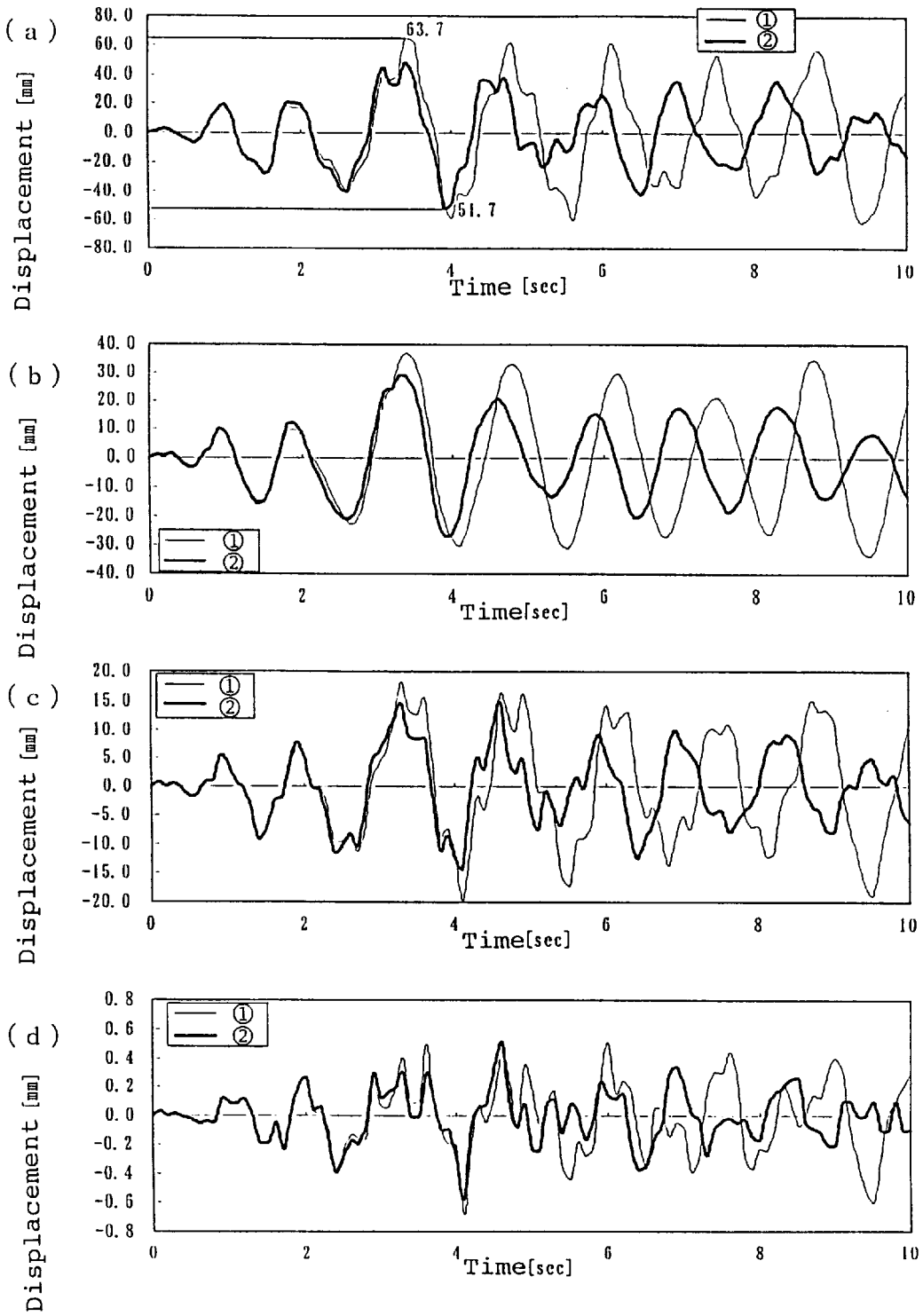
FIG. 9 shows charts illustrating transient relative displacement of a main distillation column against the ground in Example 1.
Figure 10:
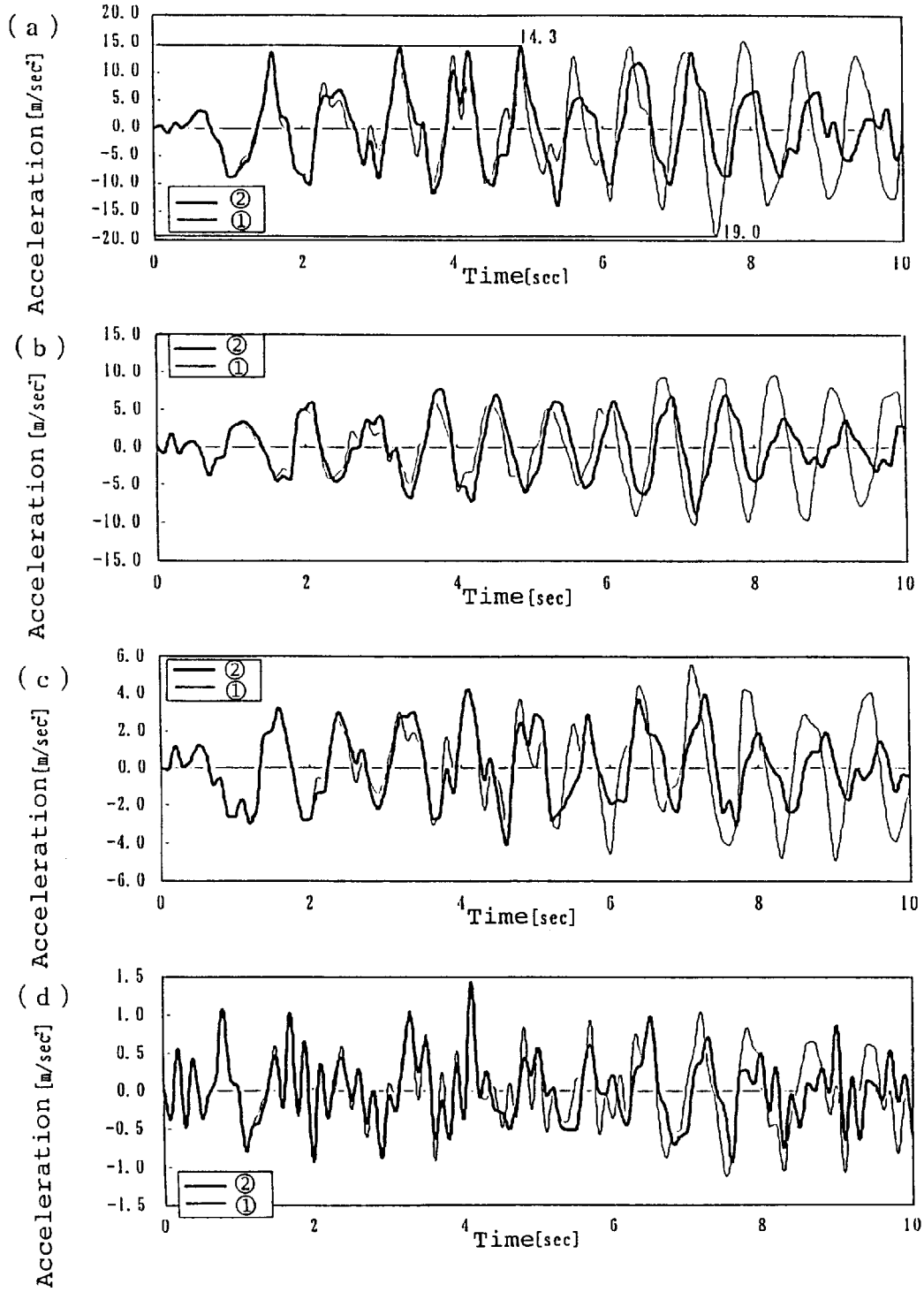
FIG. 10 shows charts illustrating transient relative acceleration of the main distillation column in Example 1.
Figure 11:
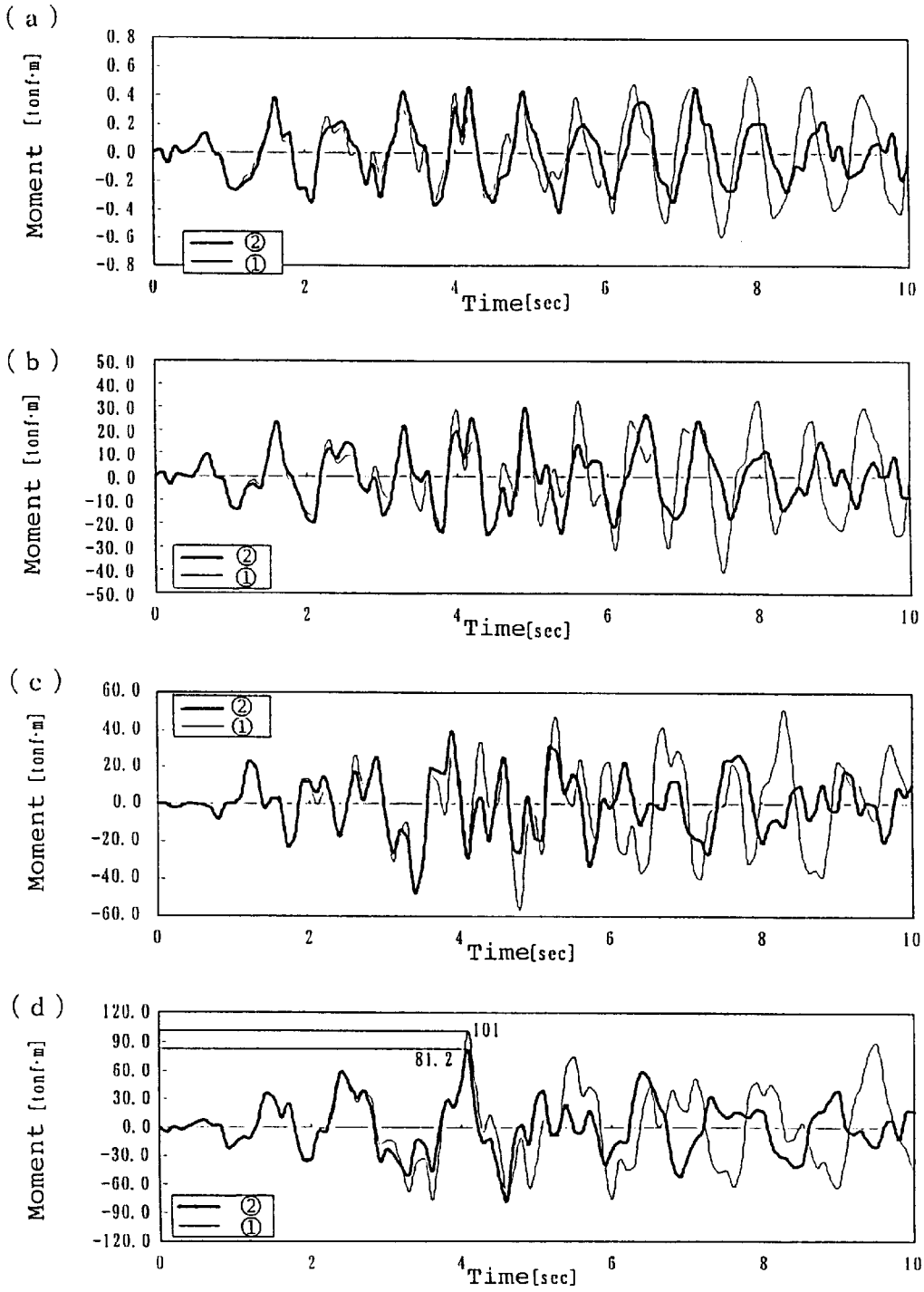
FIG. 11 shows charts illustrating transient moment of the main distillation column in Example 1.

FIG. 9 shows transient relative displacement of a free-standing main distillation column B against the ground; FIG. 10 shows transient relative acceleration of the main distillation column B; and FIG. 11 shows transient moment of the main distillation column B. In FIGS. 9, 10 and 11, transient response values at the top 21 of the main distillation column, at the upper middle part 22 of the main distillation column, at the lower middle part 23 of the main distillation column and at the bottom 24 of the main distillation column illustrated in FIG. 2 are shown in (a), (b), (c) and (d) respectively.

It can be understood in FIG. 9 that the displacement at each part of the main distillation column is a composite of the amplitude of a vibration occurring in the same direction at each part and the amplitude of a vibration occurring in the opposite directions between the top 21 of the main distillation column and the lower middle part 23 of the main distillation column with the border (node) of the upper middle part 22 of the main distillation column, i.e. a composite of the amplitude of a vibration at the first natural frequency and the amplitude of a vibration at the second natural frequency. Particularly, it can be understood that the farther it is from the node upper middle part 22 of the main distillation column, the greater becomes contribution of the second natural frequency values to the displacement. Further, the relative displacement expressed by the thick curve at the time point of about 3 seconds on is decreased by the coupling of the thermal insulator compared with that of the thin curve. Particularly, the maximum value at the top 21 of the main distillation column expressed by the thick curve is decreased to 51.7 mm at the time point of 3.9 seconds as compared to 63.7 mm of the thin curve at the time point of 3.4 seconds.

It can be understood in FIG. 10 that the relative acceleration at each part of the main distillation column B is of very high frequency unlike the waveform of the relative displacement in FIG. 9. This frequency is governed by the frequency of the strong motion record input. It can also be confirmed that the maximum relative acceleration expressed by the thick curve at the time point of about 3 seconds on is decreased by the coupling of the thermal insulator compared with that of the thin curve. Particularly, the maximum acceleration value at the top 21 of the main distillation column expressed by the thick curve is decreased to 14.3 $m/sec^2$ at the time point of 4.9 seconds as compared to 19 $m/sec^2$ of the thin curve at the time point of 7.5 seconds.

In FIG. 11, the waveform of the moment at the top 21 of the main distillation column is similar to that of acceleration at the same part (FIG. 10(*a*)), while the waveform of the moment at the upper middle part 22 of the main distillation column is also similar to the waveform of acceleration at the same part of the main distillation column (FIG. 10(*b*)). Meanwhile, it can be understood that the value of moment at the bottom 24 of the main distillation column is similar to the waveform of displacement at the same part (FIG. 9(*d*)). It can be surmised from these results that the moment occurring in the entire main distillation column is influenced greatly at the top by the acceleration, and the influence of acceleration becomes obtuse toward the bottom, so that the displacement peaks are caused to be acute. Further, it can be confirmed that the maximum moment expressed by the thick curve at the time point of about 3 seconds on is decreased compared with that of the thin curve, and particularly the maximum value at the bottom 24 of the main distillation column expressed by the thick curve is decreased to 81.2 tonf·m at the time point of 4.1 seconds as compared to 101 tonf·m of the thin curve at the time point of 4.1 seconds. Further, the maximum moment values at the other parts are also decreased, and if the displacement at the top 21 of the main distillation column B is decreased, displacement at each part of the main distillation column B is also decreased, so that the moment at each part of the free-standing main distillation column B is also decreased.

Based on the results of Example 1 described above that the maximum value of each response of all the equipments including the housing A, the sub-distillation column C disposed on the frame constituting the housing A and the self-standing main distillation column B is decreased, it can be understood that the powdery thermal insulator (trade name: Perlite, Mitsui Mining and Smelting Co., Ltd.) exerted damping effect against all of these equipments in the air separation plant in which the free-standing main distillation column B has a natural frequency of 0.7 times as large as or smaller than that of the housing A.

EXAMPLE 2

(for a free-standing distillation column having a first natural frequency in the range of 0.7 to 1.0 times as large as that of the housing)

Figure 12:
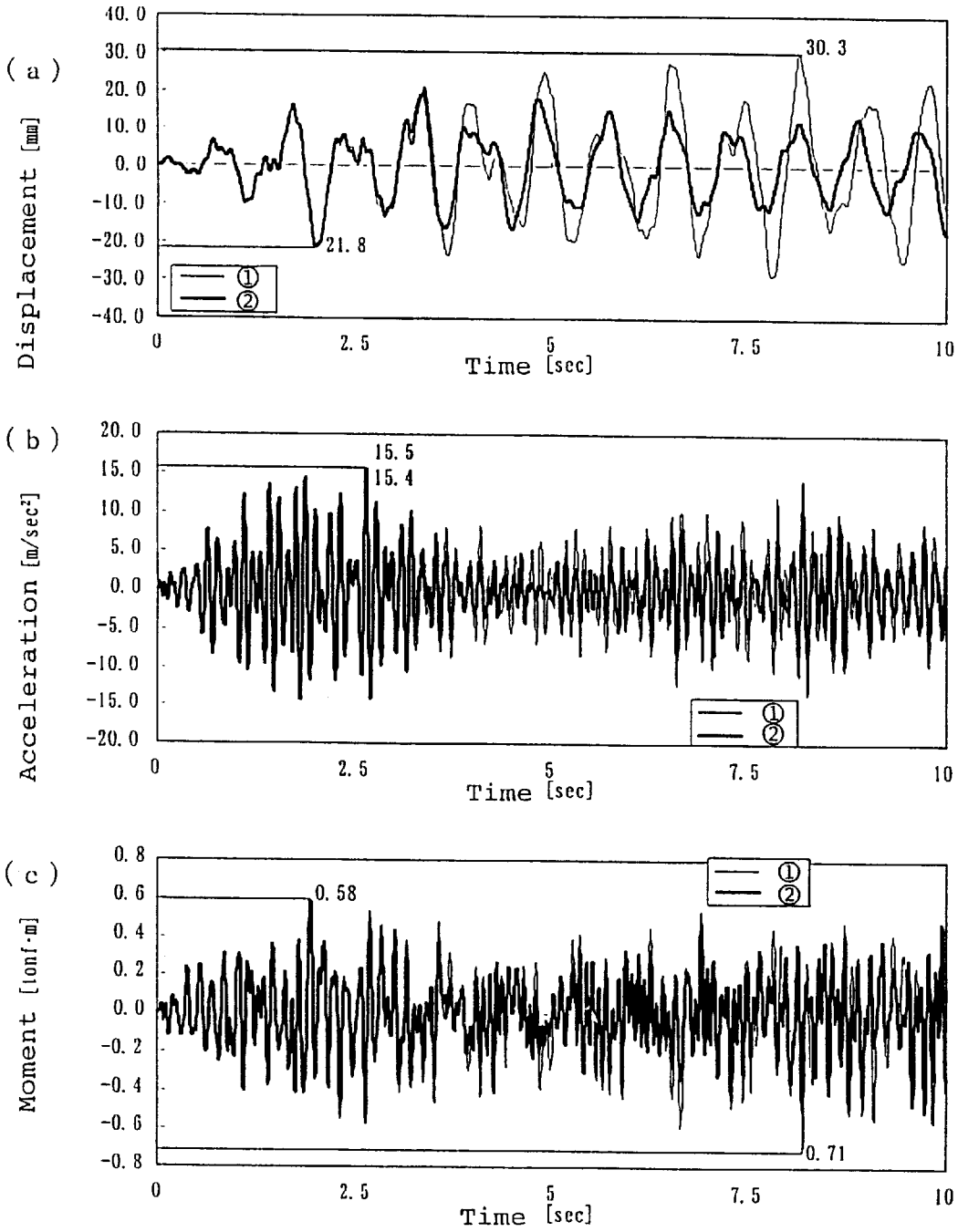
FIG. 12 shows charts illustrating transient relative displacement at the top of a housing against the ground, transient relative acceleration at the bottom of the housing; and transient moment at the bottom of the housing in Example 2, respectively.

FIG. 12(*a*) shows transient relative displacement at the top of the housing against the ground; FIG. 12(*b*) shows transient relative acceleration at the bottom 4 of the housing; and FIG. 12(*c*) shows transient moment at the bottom 4 of the housing.

It can be confirmed in FIG. 12(*a*) that the relative displacement at the top of the housing expressed by the thick curve is decreased compared with that of the thin curve like in the displacement shown in FIG. 3(*a*) where the first natural frequency is 0.7 fold or less. It can also be confirmed that, as shown in FIGS. 12(*b*) and 12(*c*), the response values (acceleration and moment) at the bottom of the housing expressed by the thick curves are decreased compared with those of thin curves like the acceleration in FIG. 4(*d*) and the moment in FIG. 5(*d*) respectively, i.e. like in the case where the first natural frequency is 0.7 fold or less. It can be understood from these results that the maximum response values of the housing A can be decreased since the housing A is influenced together with the free-standing main distillation column B by the coupling of the thermal insulator. Particularly, in a comparison of the maximum displacement values, the value expressed by the thick curve is decreased to 21.8 mm at the time point of 2 seconds as compared to 30.3 mm of the thin curve at the time point of 8.2 seconds. While the maximum acceleration value expressed by the thick curve is increased slightly to 15.5 m/sec$^2$ at the time point of 2.6 seconds as compared to 15.4 m/sec$^2$ at the time point of 2.6 seconds, the maximum moment value expressed by the thick curve is decreased to 0.58 tonf·m at the time point of 1.9 seconds as compared to 0.71 tonf·m of the thin curve at the time point of 8.2 seconds.

Figure 13:
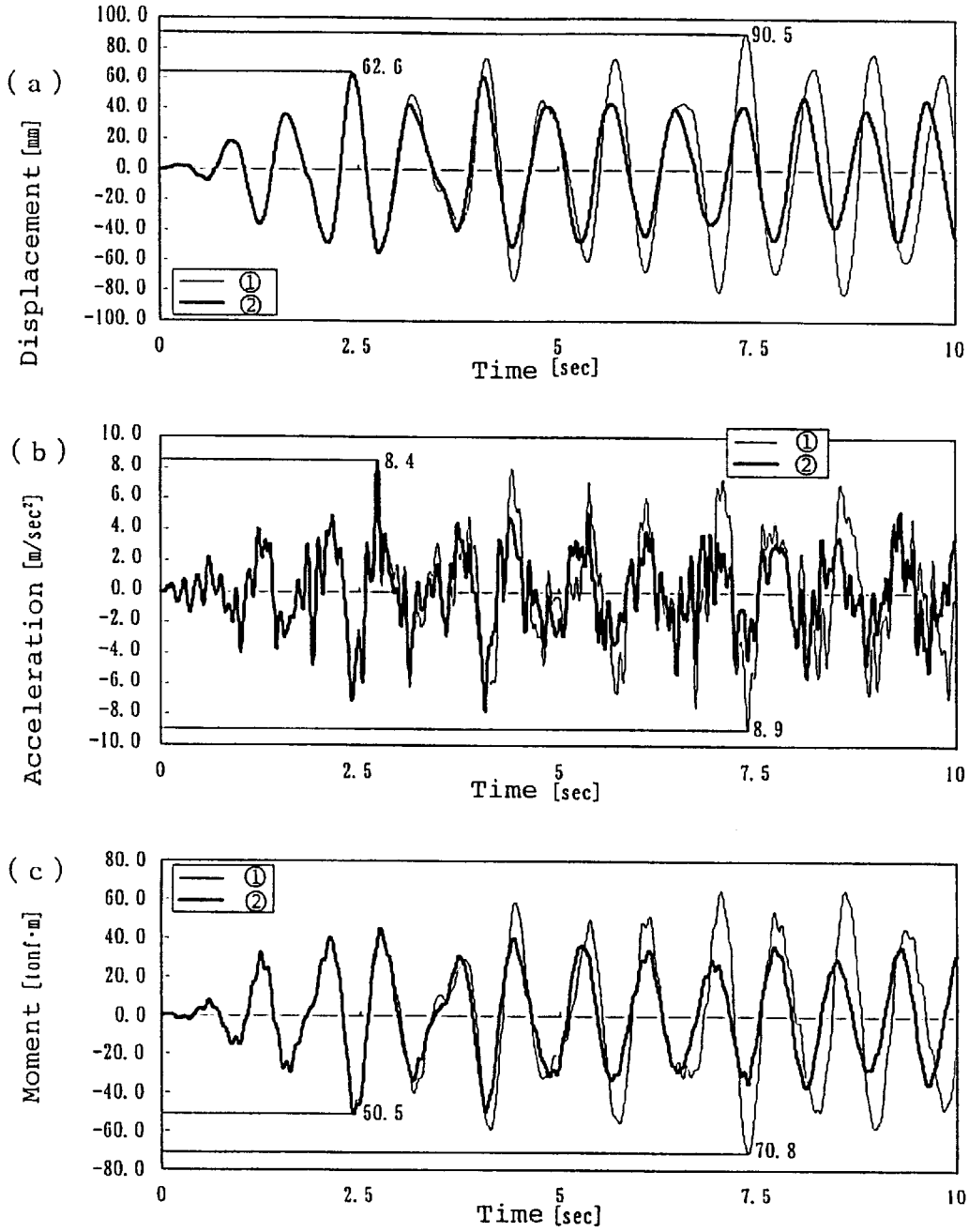
FIG. 13 shows charts illustrating transient relative displacement at the top of a sub-distillation column against the bottom thereof; transient relative acceleration at the top of the sub-distillation column; and transient moment at the bottom of the sub-distillation column in Example 2, respectively.

FIG. 13(*a*) shows transient relative displacement at the top 11 of a sub-distillation column C disposed on the frame constituting the housing A to the bottom of the column C; FIG. 13(*b*) shows transient relative acceleration at the top 11 of the sub-distillation column C; and FIG. 13(*c*) shows calculation data of transient moment at the bottom 13 of the sub-distillation column C. It can be confirmed from the calculation data shown in FIG. 13(*a*), that the relative displacement expressed by the thick curve is decreased compared with that of the thin curve like in FIG. 6 where the first natural frequency is 0.7 fold or less. It can also be confirmed in FIGS. 13(*b*) and 13(*c*) that the response values expressed by the thick curves are decreased compared with those of thin curves like in the case where the first natural frequency is 0.7 fold or less shown in FIGS. 7(*a*) and 8(*c*), respectively, and that their maximum values are also decreased.

It can be understood from these results that since the maximum response values of the housing A are decreased by being influenced together with the free-standing main distillation column B by the coupling behavior of the thermal insulator, the maximum response values of the sub-distillation column C disposed on the frame constituting the housing A are also decreased. The maximum displacement value expressed by the thick curve is decreased to 62.6 mm at the time point of 2.4 seconds as compared to 90.5 mm of the thin curve at the time point of 7.4 seconds. Meanwhile, the maximum acceleration value expressed by the thick curve is decreased to 8.4 m/sec$^2$ at the time point of 2.8 seconds as compared to 8.9 m/sec$^2$ of the thin curve at the time point of 7.4 seconds; whereas the maximum moment value expressed by the thick curve is decreased to 50.5 tonf·m at the time point of 4.1 seconds as compared to 70.8 tonf·m of the thin curve at the time point of 7.4 seconds.

Figure 14:
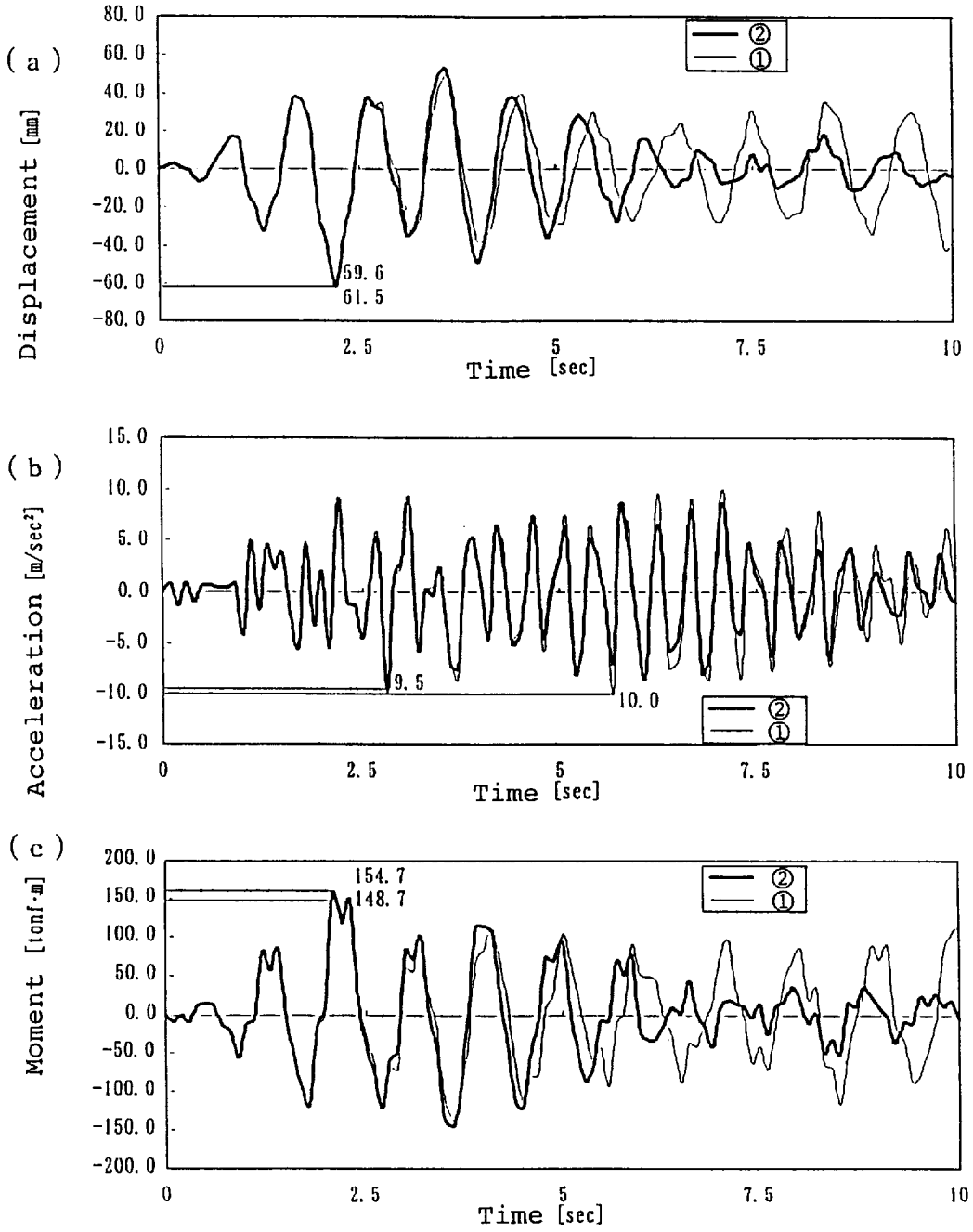
FIG. 14 shows charts illustrating transient relative displacement at the top of a main distillation column against the ground; transient relative acceleration at the top of the main distillation column; and transient moment at the bottom of the main distillation column in Example 2, respectively.

FIG. 14(*a*) shows transient relative displacement at the top 21 of a free-standing main distillation column B against the ground; FIG. 14(*b*) shows transient relative acceleration at the top 21 of the main distillation column; and FIG. 14(*c*) shows calculation data of transient moment at the bottom 24 of the main distillation column. It can be confirmed from the calculation data shown in FIG. 14 that the relative displacement expressed by the thick curve at the top 21 of the main distillation column is increased compared with that of the thin curve, unlike the tendency of the case where the first natural frequency is 0.7 fold or less shown in FIG. 9. It can also be confirmed that referring to the moment at the bottom 24 of the main distillation column, the value of moment expressed by the thick curve is increased compared with that of the thin curve like the displacement at the top 21 of the main distillation column.

It can be understood from these results that the responses of the main distillation column B are amplified when the free-standing main distillation column B is influenced together with the housing A by the coupling of the thermal insulator. The maximum displacement value expressed by the thick curve is increased to 61.5 mm at the time point of 2.2 seconds as compared to 59.6 mm of the thin curve at the time point of 2.2 seconds. Meanwhile, the maximum acceleration value expressed by the thick curve is decreased to 9.5 m/sec$^2$ at the time point of 2.1 seconds as compared to 10.0 m/sec$^2$ at the time point of 5.7 seconds; whereas the maximum moment value expressed by the thick curve is increased to 154.7 tonf·m at the time point of 2.1 seconds as compared to 148.7 tonf·m of the thin curve at the time point of 2.3 seconds.

As the results of Example 2 show, in the air separation plant containing the free-standing main distillation column B having a natural frequency of more than 0.7 times and less than 1.0 times as large as that of the housing A, the thermal insulator shows damping effect against the housing A and the sub-distillation column C disposed on the frame constituting the housing A, but it can increase in some cases responses of the free-standing main distillation column B.

EXAMPLE 3

(for a free-standing distillation column having a first natural frequency of not less than 1.0 times as large as that of the housing)

Figure 15:
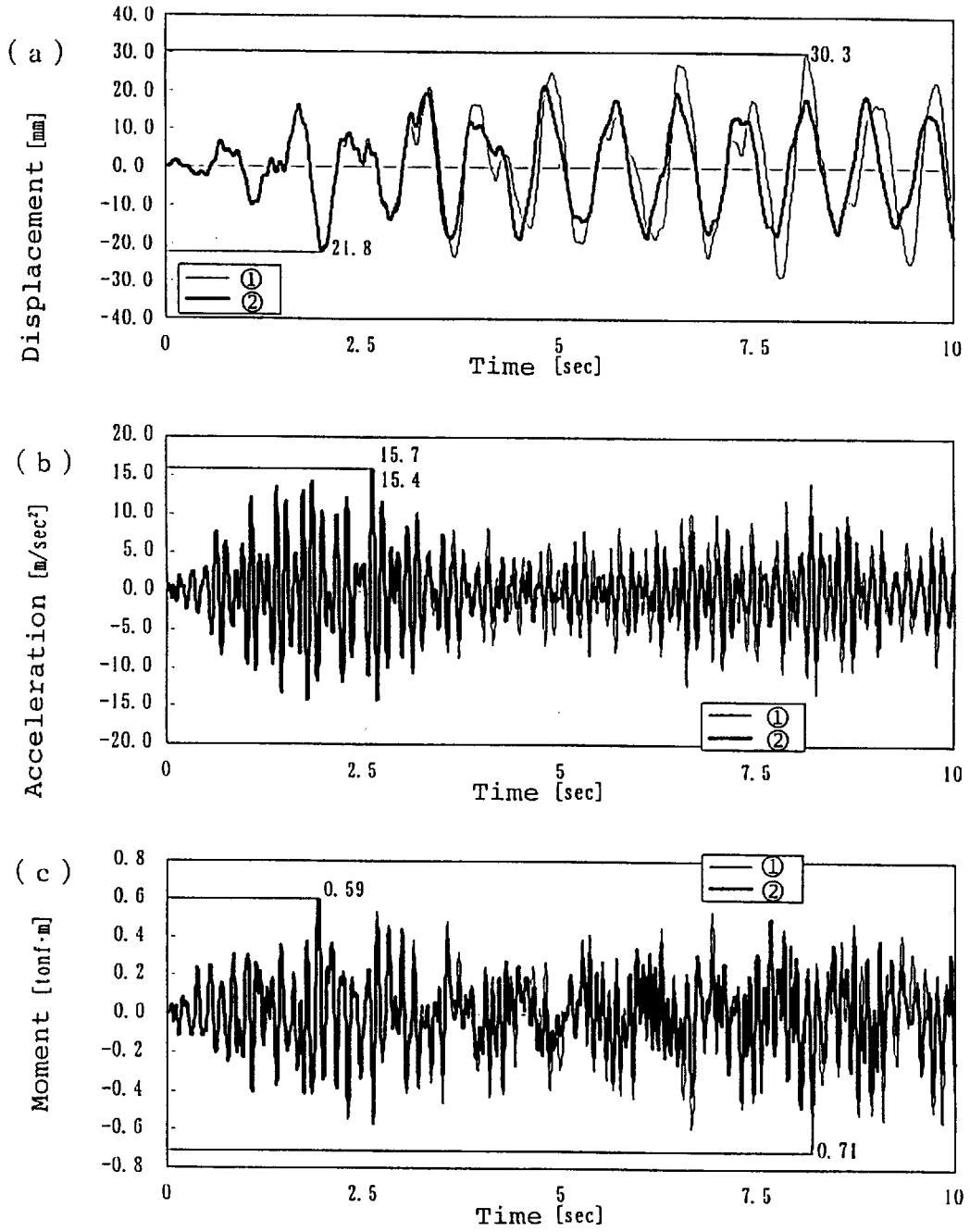
FIG. 15 shows charts illustrating transient relative displacement at the top of a housing against the ground; transient relative acceleration at the bottom of the housing; and transient moment at the bottom of the housing in Example 3, respectively.

FIG. 15(*a*) shows transient relative displacement at the top of a housing against the ground; FIG. 15(*b*) shows transient relative acceleration at the bottom of the housing; and FIG. 15(*c*) shows calculation data of transient moment at the bottom 4 of the housing. It can be confirmed in FIG. 15(*a*) that the relative displacement expressed by the thick curve is decreased compared with that of the thin curve but the degree of decrease is not so conspicuous as in the case where the natural frequency is 0.7 fold or less and where it is within the range of 0.7 to 1.0 fold. In a comparison of maximum displacement values, the value expressed by the thick curve is decreased 21.8 mm at the time point of 2 seconds as compared to 30.3 mm of the thin curve at the time point of 8.2 seconds. While the maximum acceleration value expressed by the thick curve is increased to 15.7 m/sec$^2$ at the time point of 2.6 seconds as compared to 15.4 m/sec$^2$ of the thin curve at the time point of 2.6 seconds, the maximum moment value expressed by the thick curve is decreased to 0.59 tonf·m at the time point of 1.9 seconds as compared to 0.71 tonf·m of the thin curve at the time point of 8.2 seconds.

Figure 16:
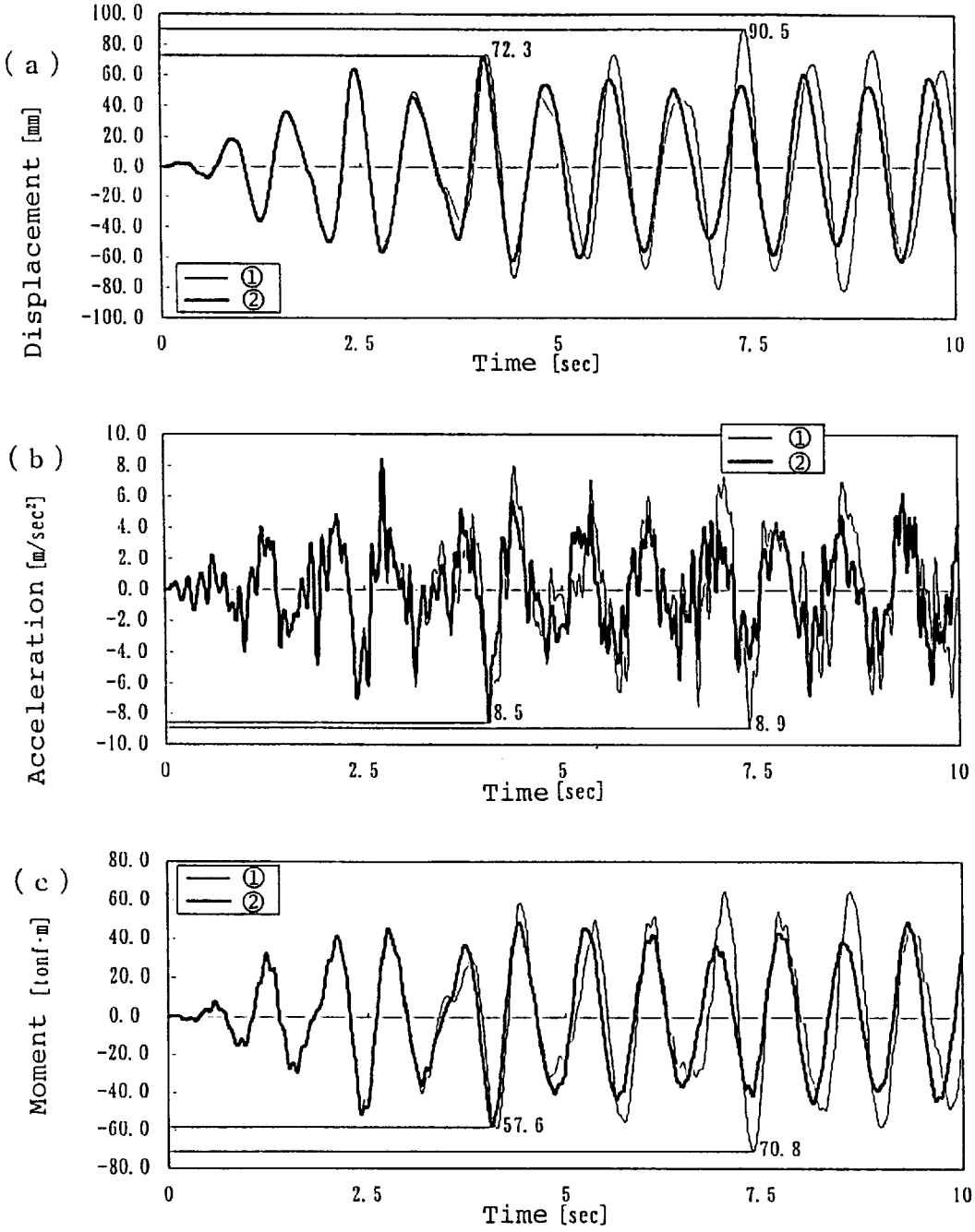
FIG. 16 shows charts illustrating transient relative displacement at the top of a sub-distillation column to the bottom thereof; transient relative acceleration at the top of the sub-distillation column; and transient moment at the bottom of the sub-distillation column in Example 3, respectively.

FIG. 16(*a*) shows transient relative displacement at the top 11 of a sub-distillation column to the bottom thereof; FIG. 16(*b*) shows transient relative acceleration at the top 11 of the sub-distillation column; and FIG. 16(*c*) shows calculation data of transient moment at the bottom 13 of the sub-distillation column. It can be confirmed in FIG. 16(*a*) that the relative displacement expressed by the thick curve is decreased compared with that of the thin curve but the degree of decrease is not so conspicuous as in the case where the natural frequency is 0.7 fold or less and where it is within the range of 0.7 to 1.0 fold. The maximum displacement value expressed by the thick curve is decreased to 72.3 mm at the time point of 4.1 seconds as compared to 90.5 mm of the thin curve at the time point of 7.4 seconds. While the maximum acceleration value expressed by the thick curve is decreased to 8.5 m/sec$^2$ at the time point of 4.1 seconds as compared to 8.9 m/sec$^2$ at the time point of 7.4 seconds, the maximum moment value expressed by the thick curve is also decreased to 57.6 tonf·m at the time point of 4.1 seconds as compared to 70.8 tonf·m of the thin curve at the time point of 7.4 seconds.

Figure 17:
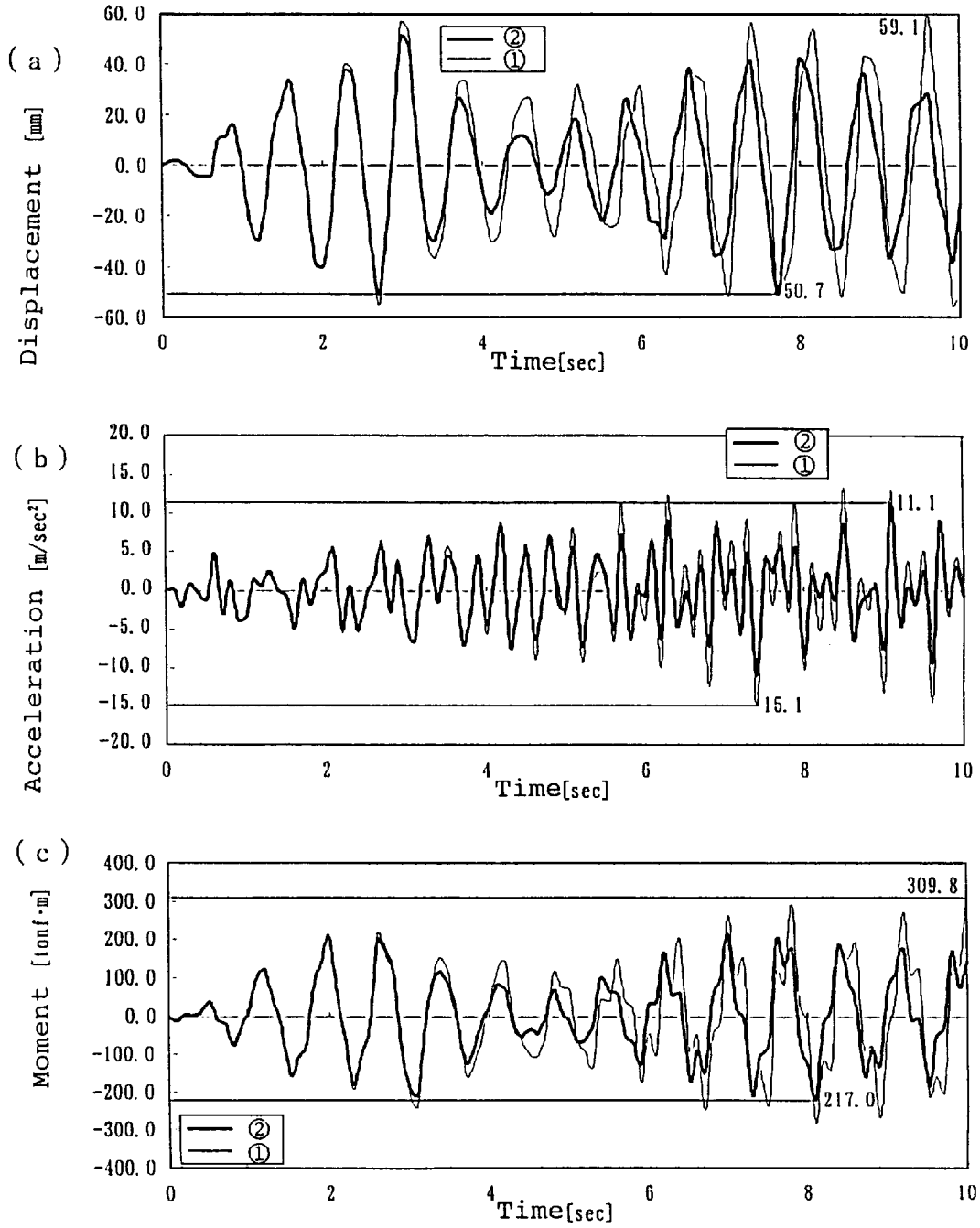
FIG. 17 shows charts illustrating transient relative displacement at the top of a main distillation column against the ground; transient relative acceleration at the top of the main distillation column; and transient moment at the bottom of the main distillation column in Example 3, respectively.

FIG. 17(*a*) shows transient relative displacement at the top 21 of a main distillation column against the ground; FIG. 17(*b*) shows transient relative acceleration at the top 21 of the main distillation column; and FIG. 17(*c*) shows calculation data of transient moment at the bottom 24 of the main distillation column. It can be confirmed in FIG. 17(*a*) that the relative displacement expressed by the thick curve is decreased compared with that of the thin curve. This shows that the responses of the main distillation column B are decreased, although the degrees of decrease are not so conspicuous as in FIG. 9 where the natural frequency is 0.7 fold or less, since the free-standing main distillation column B is influenced together with the housing A by the coupling of the thermal insulator. The maximum displacement value expressed by the thick curve is decreased to 50.7 mm at the time point of 7.7 seconds as compared to 59.1 mm of the thin curve at the time point of 9.6 seconds. While the maximum acceleration value expressed by the thick curve is decreased to 11.1 m/sec$^2$ at the time point of 9.1 seconds as compared to 15.1 m/sec$^2$ at the time point of 7.4 seconds, the maximum moment value expressed by the thick curve is decreased to 217 tonf·m at the time point of 8.1 seconds as compared to 309.8 tonf·m of the thin curve at the time point of 10 seconds.

As the results of Example 3 show, in the air separation plant containing the free-standing main distillation column B having a natural frequency of greater than that of a housing A, the thermal insulator shows damping effect against all of the housing A, the sub-distillation column C disposed on the frame constituting the housing A and the free-standing main distillation column B.

It can also be understood from Examples 1 to 3 described above, the damping effect of the thermal insulator against an air separation plant can be confirmed in terms of the maximum displacement values at the top of each equipment and of the housing.

Further, the damping effect of the powdery thermal insulator against responses of the housing and columns such as distillation columns, storage tanks, heat exchangers, etc. disposed in the housing to an earthquake changes depending on its state. That is, the stiffness of the powdery thermal insulator is increased due to cyclic compressive loading and tends to unite the columns with the housing with this cyclic compressing loading and to increase slightly the natural frequency values of the columns and of the housing. In this case, the thermal insulator exerts its damping effect to reduce responses of relatively rigid equipments (those having high natural frequency values) irrespective of the natural frequency values of flexible equipments. However, responses of relatively flexible equipments can occasionally be increased depending on the relationship with the natural frequency values of the rigid equipments.

Figure 18:
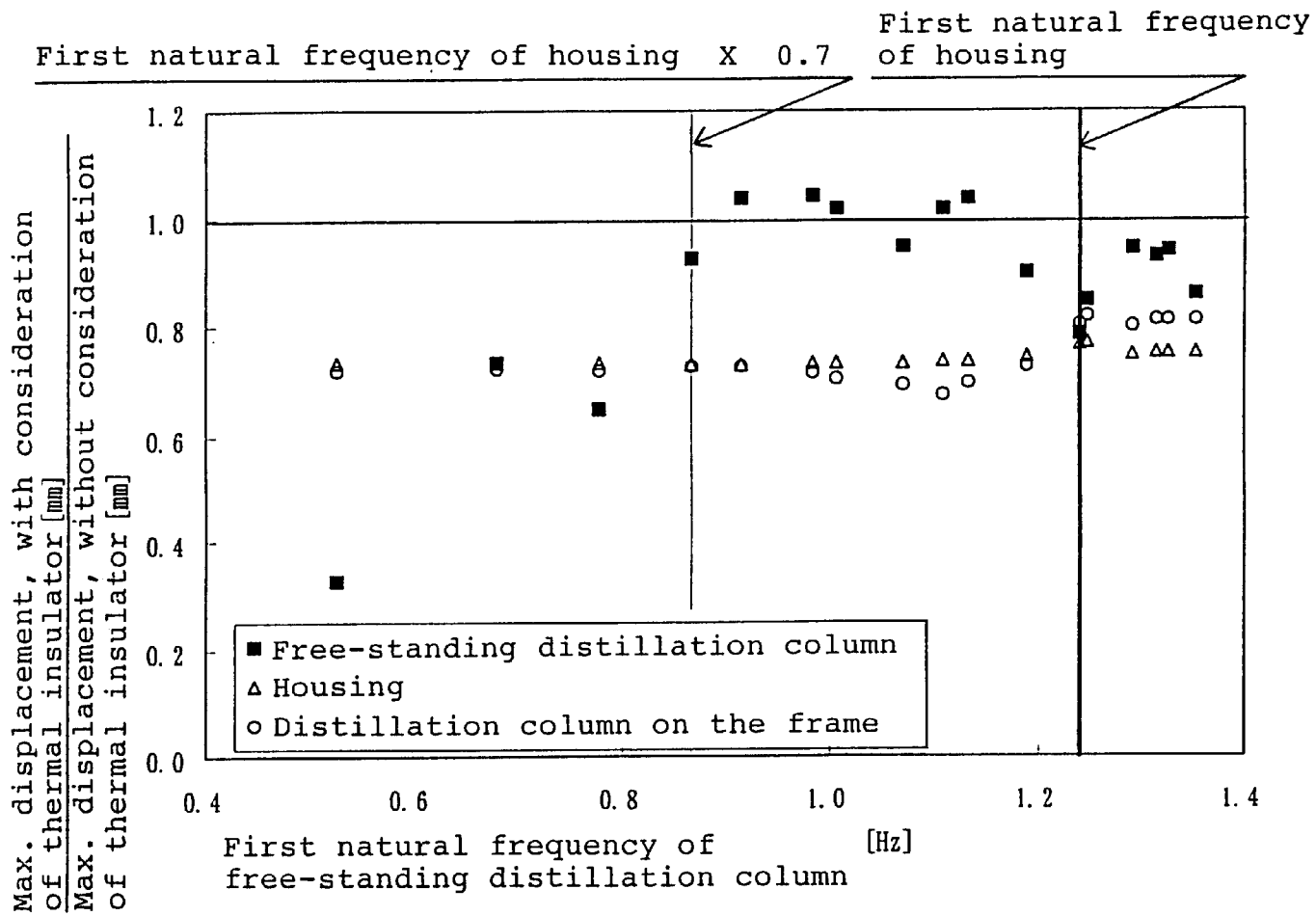
FIG. 18 is a chart showing ratio of the maximum response displacement at the top of each equipment of a case where the coupling of the thermal insulator is not considered to the maximum response displacement of a case where the coupling of the thermal insulator is considered, when the first natural frequency of a housing is fixed and the first natural frequency of a free-standing distillation column is changed.

FIG. 18 shows ratio of the maximum response displacement at the top of each equipment of a case where the coupling behavior of the thermal insulator is not considered to the maximum response displacement of a case where the coupling behavior of the thermal insulator is considered in a discussion of models including those in Examples 1 to 3, in which the first natural frequency of the housing was fixed to 1.24 Hz and the first natural frequency of the free-standing distillation column was changed between 0.5 and 1.4 Hz. In FIG. 18, the closed square shows calculation data of response at the top of the free standing distillation column (the top 21 of the main distillation column in FIG. 2); the open triangle shows calculation data of response at the top of the housing (the top of the housing in FIG. 2); and the open circle shows calculation data of response at the top of the distillation column disposed on the frame constituting the housing (the top 11 of the sub-distillation column in FIG. 2). In FIG. 18 again, it can be confirmed that there are cases where responses of relatively rigid equipments are decreased irrespective of the natural frequency values of flexible equipments, and responses of the relatively flexible equipments are increased in some cases depending on the relationship with the natural frequency values of the rigid equipments.

Accordingly, responses of the housing can be decreased by the damping effect of the thermal insulator by comparing the natural frequency of the aseismatically designed housing and that of the free-standing distillation column and by selecting a higher natural frequency for the housing. Responses of the distillation column disposed on the frame constituting the housing can be decreased likewise. Further, responses of the free-standing distillation column can also be decreased by setting the natural frequency of the column to not more than 0.7 times or not less than 1.0 times as large as that of the housing.

It should be noted here that the air separation plant containing one sub-distillation column C disposed on the frame constituting the housing A and one free-standing distillation column B was described in any of the foregoing Examples. However, the present invention can, of course, be applied to those cases where the plant contains two or more such columns respectively and that the plant can contain heat exchangers and other equipments such as liquid storage tanks, condensers, reboilers and condenser-reboilers as well as the distillation columns.

It should be apparent to those skilled in the art that the present invention may be embodied in many other specific forms without departing from the spirit or scope of the invention. Therefore, the present examples and embodiments are to be considered as illustrative and not restrictive, and the invention is not to be limited to the details given herein, but may be modified within the scope of the appended claims.

What is claimed is:

1. An air separation plant comprising:

a housing for containing cryogenic equipments, said housing having a frame;

at least one free-standing column disposed in the housing;

at least one other column disposed in the housing on said frame of the housing; and a particulate thermal insulation material packed in the housing, said material having a packing density obtained by packing under atmospheric pressure and aseismatically coupling said housing with said free-standing column by setting the free-standing column to have a first natural frequency of not more than 0.7 times as small as that of the housing.

2. The air separation plant according to claim 1, wherein the particulate thermal insulation material has a packing density in the range of 55 to 80 kg/m$^3$.

3. An air separation plant comprising:

a housing for containing cryogenic equipments, said housing having a frame;

at least one free-standing column disposed in the housing;

at least one other column disposed in the housing on said frame of the housing; and a particulate thermal insulation material packed in the housing, said material having a packing density obtained by packing under atmospheric pressure and aseismatically coupling said housing with said free-standing column by setting the free-standing column to have a first natural frequency of not less than 1.0 times as large as that of the housing.

4. The air separation plant according to claim 3, wherein the particulate thermal insulation material has a packing density in the range of 55 to 80 kg/m$^3$.

5. A method for constructing an aseismatic air separation plant comprising the steps of:

providing a housing for containing cryogenic equipments;

disposing at least one free-standing column within the housing;

packing the housing about said column with a particulate thermal insulation material to aseismatically couple said column with said housing, said particulate thermal insulation material being packed under atmospheric pressure to an extent to provide said at least one free-standing column with a first natural frequency of not more than 0.7 times as small as that of the housing.

6. A method for constructing an aseismatic air separation plant comprising the steps of:

providing a housing for containing cryogenic equipments;

disposing at least one free-standing column within the housing;

packing the housing about said column with a particulate thermal insulation material to aseismatically couple said column with said housing, said particulate thermal insulation material being packed under atmospheric pressure to an extent to provide said at least one free-standing column with a first natural frequency of not less than 1.0 times as large as that of the housing.

* * * * *